US006771016B2

(12) United States Patent
Morimoto

(10) Patent No.: US 6,771,016 B2
(45) Date of Patent: Aug. 3, 2004

(54) INLINE ELECTRON GUN AND COLOR CATHODE RAY TUBE

(75) Inventor: Hiroji Morimoto, Kashihara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 51 days.

(21) Appl. No.: 10/210,911

(22) Filed: Aug. 1, 2002

(65) Prior Publication Data

US 2003/0025436 A1 Feb. 6, 2003

(30) Foreign Application Priority Data

Aug. 6, 2001 (JP) ..... 2001-238312

(51) Int. Cl.[7] ..... H01J 29/50
(52) U.S. Cl. ..... 313/414
(58) Field of Search ..... 313/414

(56) References Cited

U.S. PATENT DOCUMENTS 6,133,684 A 10/2000 Kawaharada

FOREIGN PATENT DOCUMENTS

| | | |
|---|---|---|
| EP | 0 971 385 | 1/2000 |
| JP | 4-133247 | 5/1992 |
| WO | WO 01/11654 | 2/2001 |

*Primary Examiner*—Vip Patel
(74) *Attorney, Agent, or Firm*—Merchant & Gould P.C.

(57) ABSTRACT

An inline electron gun and a color cathode ray tube provided with the inline electron gun for reducing the manufacturing cost for an assembly jig of the electron gun, for example, that might be generated with a change in the size of the cathode ray tube and for realizing a favorable static convergence property is provided. The inline gun includes a first flat plate electrode, a second flat plate electrode, two cylindrical electrodes at least is used. An opening geometry of outer passage holes provided in the first flat plate electrode and the second flat plate electrode is configured by combining an inner curve and an outer curve, which have different degrees. The opening geometries of the outer passage holes are symmetric with respect to a line. At least one of the outer curves and the inner curves in the outer passage holes have different degrees.

6 Claims, 3 Drawing Sheets

INLINE ELECTRON GUN AND COLOR CATHODE RAY TUBE

BACKGROUND OF THE INVENTION

1. Field of the Invention

The present invention relates to an inline electron gun and a color cathode ray tube using the same. More specifically, the present invention relates to a cylindrical electrode and a flat plate electrode with holes, which make up a main electrostatic lens of the inline electron gun.

2. Related Background Art

In conventional inline electron guns, as disclosed in JP 4(1992)-133247 A, for example, a main electrostatic lens is made up of a G3 electrode and a G4 electrode. The G3 electrode includes: a cylindrical outer electrode with a common aperture having an approximately oval-shape in cross-section and surrounding three electron beams; and a flat plate electrode provided within the outer electrode and having three passage holes for letting each of three electron beams pass therethrough. The G4 electrode has the same configuration as the G3 electrode.

In the following, the G3 electrode and G4 electrode included in the conventional inline electron gun disclosed in the above publication will be explained, with reference to FIG. 4. FIG. 4A is a cross-sectional view of the G3 electrode and G4 electrode in the conventional inline electron gun, FIG. 4B is a front view of the G3 electrode from the arrow A of FIG. 4A, and FIG. 4C is an enlarged view of a part of the flat plate electrode illustrated in FIG. 4B.

In FIG. 4A, reference numeral 41 denotes a cylindrical electrode with an aperture having an approximately oval-shape in cross-section, 42 also denotes a cylindrical electrode with an aperture having an approximately oval-shape in cross-section, 43 denotes a flat plate electrode provided within the cylindrical electrode 41, and 44 also denotes a flat plate electrode provided within the cylindrical electrode 42. These cylindrical electrode 41 and flat plate electrode 43 make up a G3 electrode 410, and the cylindrical electrode 42 and the flat plate electrode 44 make up a G4 electrode 420. Reference numerals 45 to 47 denote passage holes provided in the flat plate electrode 43, and 50 to 52 denote passage holes provided in the flat plate electrode 44. These passage holes are provided for letting three electron beams pass therethrough.

The three passage holes provided in each of the flat plate electrodes, as shown in FIG. 4B, are arranged along the inline direction (hereinafter also referred to as a "horizontal direction"). FIG. 4B shows the passage holes 45, 46 and 47 provided in the flat plate electrode 43. The opening geometry of the passage hole 46 and that of the passage hole 47 are symmetric with respect to a center line of the passage hole 45 along a direction orthogonal to the inline direction (hereinafter referred to as a "vertical direction"). It should be noted that the geometries of the passage holes 50, 51 and 52 provided in the flat plate electrode 44 have the same as the passage holes 44, 45 and 46, respectively.

As shown in FIG. 4C, the passage hole 45 located at the center of the three holes provided in the flat plate electrode 43 has an oval shape with a major axis along the vertical direction. Whereas, as shown in FIG. 4C, the passage hole 47 located at either outer side (FIG. 4C shows the passage hole 47 only) has an outer half portion 49 in a semicircle shape and an inner half portion 48 configured in a higher-order curved shape with a degree of n more than 2 and not more than 3. It should be noted that in this specification the "inner side" refers to a direction toward the passage hole located at the center of the flat plate electrode, while the "outer side" refers to a direction away from the passage hole located at the center of the flat plate electrode.

In this way, the G3 electrode 410 and the G4 electrode 420 that make up a main electrostatic lens of an inline electron gun include: the outer cylindrical electrodes 41 and 42 with an opening geometry in an approximately oval shape with a major axis along the horizontal direction as shown in FIG. 4; and the flat plate electrodes 43 and 44 provided within the cylindrical electrodes 41 and 42, respectively, arranged at a recessed position from each opening of the cylindrical electrodes, and having three passage holes.

With this configuration, electron beams passing through the center passage holes 45 and 50 are acted upon by an independent electric field formed by the passage holes 45 and 50 and a superimposed electric field formed by the straight-line portion of the periphery of the cylindrical electrodes 41 and 42. Electron beams passing through the passage holes 46 and 51 or 47 and 52, located at both outer sides, are acted upon by an independent electric field formed by the passage holes 46 and 51 or an independent electric field formed by the passage holes 47 and 52, and the superimposed electric field formed by the curved-line portion of the periphery of the cylindrical electrodes 41 and 42.

In the conventional inline electron guns, a convergence function (static convergence) for three electron beams can be optimized by appropriately selecting the degree n of the higher-order curved portion (e.g., 48 in FIG. 4C) of the passage holes 46, 47 and 51, 52 at either outer side of the flat plate electrodes 43 and 44, facing to the central passage holes 45 and 50, and therefore an electron beam that reaches a screen finally can be made close to a perfect circle.

Now, in order to change the size of a cathode ray tube so as to be increased or decreased in size, and not redesigning the above-described conventional inline electron gun, then the cathode ray tube increases or decreases in size along the tube axis direction, which would degrade the static convergence property of three electron beams on the screen.

In the case of a small change in the size of the cathode ray tube, such degradation in the static convergence property may be improved with a magnet or the like disposed outside of the cathode ray tube.

However, when the static convergence property deteriorates beyond the capability of such a magnet or the like, a design of components of the electron gun and the applied voltage have to be changed so as to give a higher priority to the static convergence property on the screen.

More specifically, in order to maintain the static convergence property, the opening geometry of the passage holes provided in the flat plate electrodes of the G3 electrode and the G4 electrode has to be changed significantly, or the voltage applied to the G3 electrode has to be changed. As for the change in the voltage applied to the G3 electrode, there are many restrictions such as the voltage to be applied becoming so high that dielectric breakdown might occur, or the applied voltage cannot be changed in terms of the power source. In such cases, a pitch of small apertures in a G1 electrode has to be changed.

In addition, such a substantial change in the passage holes in the flat plate electrodes of the G3 electrode and the G4 electrode and the aperture pitch of the G1 electrode would lead to a situation where an assembly jig of the electron gun used before change cannot be used, and therefore a new assembly jig should be prepared, which would increase the cost of the assembly of the electron gun.

SUMMARY OF THE INVENTION

Therefore, with the foregoing in mind, it is an object of the present invention to provide an inline electron gun and a color cathode ray tube including the same, by which the manufacturing cost for an assembly jig of the electron gun can be reduced, for example, that might be generated with a change in the size of the cathode ray tube, and a favorable static convergence property can be realized.

To fulfill the above-stated object, an inline electron gun according to the present invention emits three electron beams aligned along a horizontal direction, and the inline electron gun includes: a cylindrical low potential side electrode provided with a first flat plate electrode; and a cylindrical high potential side electrode provided with a second flat plate electrode, where the low potential side electrode and the high potential side electrode are arranged in the stated order along a direction in which the electron beams are headed so as to make up a main electrostatic lens. In the inline electron gun, each of the first flat plate electrode and the second flat plate electrode has a central passage hole for letting a central electron beam of the three electron beams pass therethrough and two outer passage holes for letting each of the other two outer electron beams pass therethrough. Each of the opening geometries of the two outer passage holes in the first flat plate electrode and each of the opening geometries of the two outer passage holes in the second flat plate electrode are configured with a higher-order curve. Each of the opening geometries of the two outer passage holes in at least one of the first flat plate electrode and the second flat plate electrode is formed by combining two higher-order curves having different degrees with a boundary on a center line of the outer passage hole along a vertical direction. An opening geometry of one outer passage hole and an opening geometry of the other outer passage hole provided in a same flat plate electrode are symmetric with respect to a center line of a central passage hole provided in the same flat plate electrode along the vertical direction, and in a higher-order curve forming the opening geometries of the outer passage holes provided in the first flat plate electrode, at least one of (a) inner portions of the higher-order curve located at the side of the central passage hole with respect to the center lines of the respective outer passage holes along the vertical direction and (b) outer portions of the higher-order curve located outside have a different degree from that of corresponding portions of a higher-order curve forming the opening geometries of the outer passage holes provided in the second flat plate electrode.

To fulfill the above-stated object, a color cathode ray tube according to the present invention includes at least the above-described inline electron gun according to the present invention.

DETAILED DESCRIPTION OF THE INVENTION

Figure 1:
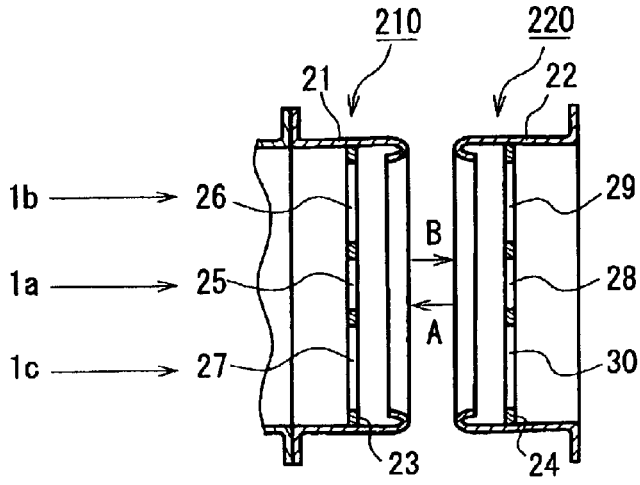
FIG. 1 shows a construction in cross-section that shows a part of the inline electron gun according to one embodiment.

In the inline electron gun according to the present invention, when comparing outer passage holes located opposite each other, a higher-order curve of an opening geometry of an outer passage hole provided in a first flat plate electrode in a lower potential side electrode (G3 electrode) and a higher-order curve of an opening geometry of an outer passage hole provided in a second flat plate electrode in a higher potential side electrode (G4 electrode) are designed so that at least the degrees of both inner portions of the curves or both outer portions of the curves are different from each other.

In a preferred embodiment of the inline electron gun according to the present invention, the outer passage holes provided in the first flat plate electrode and the outer passage holes provided in the second flat plate electrode are different from each other in their degrees of the inner portions of the higher-order curves. In this case, it is preferable that the degree of the outer portions of the higher-order curves of the outer passage holes provided in the first flat plate electrode is the same as that of the outer passage holes provided in the second flat plate electrode, where the degree is 2.

According to the inline electron gun of the present invention, a static convergence property can be made favorable by shifting a center position of each electrostatic lens freely in the horizontal direction. Such a capability in shifting the center position of the electrostatic lens freely in the horizontal direction will be described in terms of the relationship between the outer passage holes in the first and the second flat plate electrodes and the pitch of the small apertures in the G1 electrode, based on the following specific examples (1) to (4).

Here, it is known that an electrostatic lens formed by the passage holes for letting electron beams pass therethrough exerts a convergence action at a lower potential side and a divergence action at a higher potential side, with respect to an electron beam. From this point, an optical model is utilized in many cases for considering the electrostatic lens. In the optical model, the convergence action of the electrostatic lens at the lower potential side is represented by a convex lens, whereas the divergence action of the electrostatic lens at the higher potential side is represented by a concave lens.

In addition, in this specification, among two higher-order curves making up the opening geometry of the outer passage holes, a portion of the higher-order curve located at the side of the central passage hole with respect to a vertical center line of the outer passage hole is referred to as an "inner curve" and a portion of the higher-order curve located at the opposite side to the central passage hole with respect to the center line is referred to as an "outer curve".

(1) When the degree of the inner curves of the outer passage holes provided in the first flat plate electrode is set at less than 2, then an inner opening area of the outer passage holes becomes small. Therefore, an inner convergence action by the outer passage holes becomes strong, so that the effective center position of the convex lens shifts toward the outside in the horizontal direction. As a result, a pitch of the small apertures in the G1 electrode required for obtaining a favorable static convergence property becomes large.

(2) When the degree of the outer curves of the outer passage holes provided in the first flat plate electrode is set at less than 2, then an outer opening area of the outer passage holes becomes small. Therefore, an outer convergence action by the outer passage holes becomes strong, so that the effective central position of the convex lens shifts toward the inside in the horizontal direction. As a result, a pitch of the small apertures in the G1 electrode required for obtaining a favorable static convergence property becomes small.

(3) When the degree of the inner curves of the outer passage holes provided in the second flat plate electrode is set at less than 2, then an inner opening area of the outer passage holes becomes small. Therefore, an inner convergence action by the outer passage holes becomes strong, so that the effective central position of the concave lens shifts toward the outside in the horizontal direction. As a result, a pitch of the small apertures in the G1 electrode required for obtaining a favorable static convergence property becomes small.

(4) When the degree of the outer curves of the outer passage holes provided in the second flat plate electrode is set at less than 2, then an outer opening area of the outer passage holes becomes small. Therefore, an outer convergence action by the outer passage holes becomes strong, so that the effective central position of the concave lens shifts toward the inside in the horizontal direction. As a result, a pitch of the small apertures in the G1 electrode required for obtaining a favorable static convergence property becomes large.

In the above (1) to (4), when the degree of the higher-order curves is set at more than 2, the above-mentioned convergence action or divergence action becomes weak, so that a change in the pitch of the small apertures in the G1 electrode required for obtaining a favorable static convergence property becomes an inversion of the results of the above (1) to (4).

Through the use of the actions described in the above (1) to (4) as appropriate, in the case of a change in the size of the cathode ray tube, an increase or a decrease in the pitch of the small apertures in the G1 electrode can be adjusted by changing the opening geometry of the outer passage holes in the first and the second flat plate electrodes. Thereby, a favorable static convergence property can be obtained without changing the pitch of the small apertures in the G1 electrode.

For instance, when the size of the cathode ray tube is increased, since a distance between the electron gun and the screen becomes small, both outer electron beams pass through the screen and then cross each other. In this state, if a higher priority is given to a favorable static convergence property so that the static convergence property can be in the best condition on the screen, that is, three electron beams cross one another on the screen, then outer electron beams at the G1 electrode are located outside of the outer small apertures. Therefore, the pitch of the small apertures has to be made larger.

In this case, in order to obtain a favorable static convergence property without changing the pitch of the small apertures, the above (2) or (3) can be applied. As a result, the pitch of the small apertures can be made smaller, so that deterioration in the static convergence property due to the change in the size of the cathode ray tube can be suppressed.

Note here that the "horizontal direction" mentioned in this specification means a horizontal direction on the screen, which is orthogonal to the tube axis of the color cathode ray tube, whereas the "vertical direction" means a vertical direction on the screen.

The following describes the inline electron gun according to the embodiments of the present invention, with reference to FIGS. 1 to 3.

FIG. 1 shows a construction in cross-section that shows a part of the inline electron gun according to one embodiment. According to the inline electron gun of this embodiment, three electron beams 1*a*, 1*b* and 1*c* emitted from cathodes (not illustrated) aligned along the horizontal direction are controlled by electrostatic lenses. FIG. 1 shows a lower potential side electrode (G3 electrode) 210 and a higher potential side electrode (G4 electrode) 220, which are a part of the inline electron gun according to this embodiment.

The lower potential side electrode 210 and the higher potential side electrode 220 are arranged in the stated order along the direction in which the electron beams 1*a*, 1*b* and 1*c* are headed. The lower potential side electrode 210 is composed of a cylindrical electrode 21 having a first flat plate electrode 23 within it. The higher potential side electrode 220 is composed of a cylindrical electrode 22 having a second flat plate electrode 24 within it.

The first flat plate electrode 23 is provided with a central passage hole 25 for letting a central electron beam 1*a* pass therethrough and outer passage holes 26 and 27 for letting outer electron beams 1*b* and 1*c* pass therethrough, respectively. Similarly, the second flat plate electrode 24 is provided with a central passage hole 28 and outer passage holes 29 and 30. Thus, according to this embodiment, the three passage holes 25, 26 and 27 provided in the first flat plate electrode 23 and the three passage holes 28, 29 and 30 provided in the second flat plate electrode 24 form three electrostatic lenses.

The first flat plate electrode 23 and the second flat plate electrode 24 are located at a recessed position from the respective opening end of the G3 electrode 210 and G4 electrode 220. It should be noted that the inline electron gun according to this embodiment may include a G1 electrode, a G2 electrode and cathodes, which are not illustrated in the drawings, in addition to the G3 electrode 210 and the G4 electrode 220. A color cathode ray tube according to this embodiment can be obtained by inserting this inline electron gun into a glass bulb.

Figure 2A:
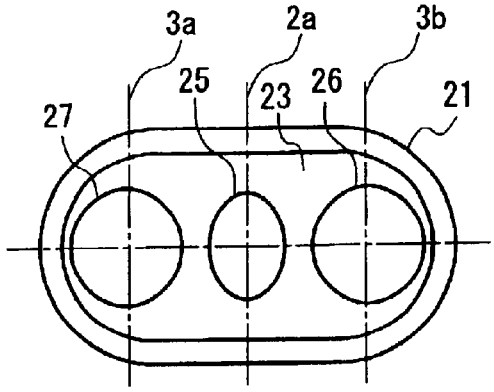
FIG. 2A is a view of the lower potential side electrode (G3 electrode) 210 in the direction of the arrow A in FIG. 1.
Figure 2B:
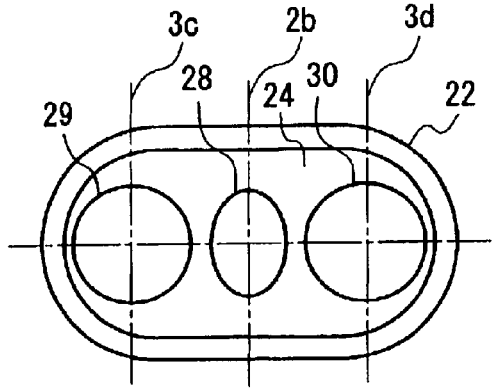
FIG. 2B is a view of the higher potential side electrode (G4 electrode) 220 in the direction of the arrow B in FIG. 1.

The following describes the passage holes 25 to 30, with reference to FIG. 2. FIG. 2A is a view of the lower potential side electrode (G3 electrode) 210 in the direction of the arrow A in FIG. 1. FIG. 2B is a view of the higher potential side electrode (G4 electrode) 220 in the direction of the arrow B in FIG. 1.

As shown in FIGS. 2A and 2B, the geometry of the first flat plate electrode 23 and the second flat plate electrode 24 is an approximately oval shape with a major axis along the horizontal direction. Therefore, the opening geometry in cross-section of the G3 electrode 210 and the G4 electrode 220 also is an approximately oval shape with a major axis along the horizontal direction. A low voltage of approximately 5 kV to 10 kV generally is applied to the G3 electrode 210, and a high voltage of approximately 20 kV to 35 kV generally is applied to the G4 electrode 220.

In addition, as shown in FIG. 2A, the opening geometry of the central passage hole provided in the first flat plate electrode 23 is an oval shape with a major axis along the vertical direction. Meanwhile, the opening geometry of the outer passage holes 26 and 27 provided in the first flat plate electrode 23 is configured by combining two higher-order curves. These two higher-order curves have different degrees with a boundary on a center line 3*a* and 3*b* (hereafter called an "outer center line") of the respective outer passage holes along the vertical direction (See FIG. 3, which will be described later). The opening geometry of the outer passage hole 26 and that of the outer passage hole 27 are symmetric with respect to a center line 2*a* (hereafter called a "central center line") of the central passage hole 25 along the vertical direction.

Similarly, as shown in FIG. 2B, the opening geometry of the central passage hole 28 provided in the second flat plate electrode 24 is an oval shape similar to that of the central passage hole 25. The opening geometry of the outer passage holes 29 and 30 provided in the second flat plate electrode 24 also is configured by combining two higher-order curves in a like manner as in the outer passage holes 26 and 27. These higher-order curves also have different degrees with a boundary on a center line 3*c* or 3*d* (See FIG. 3, which will be described later). The opening geometry of the outer passage hole 29 and that of the outer passage hole 30 also are symmetric with respect to a center line 2*b*.

Figure 3A:
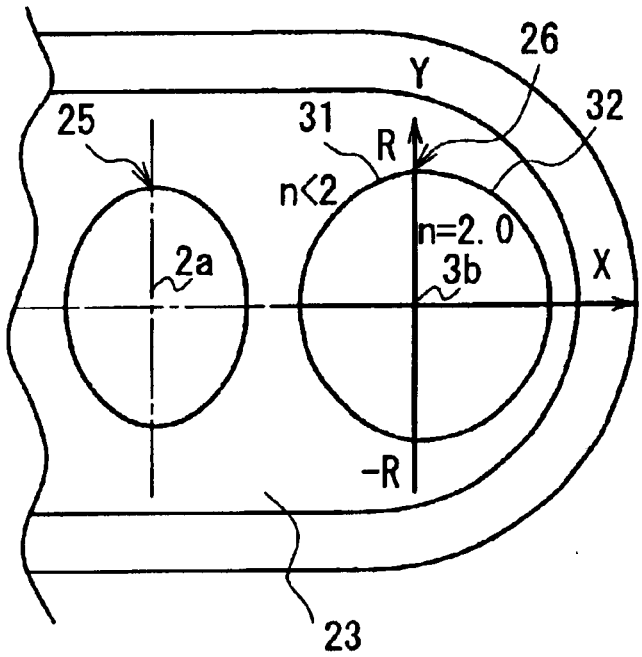
FIG. 3A is an enlarged view showing a part of the first flat plate electrode shown in FIG. 2A.
Figure 3B:
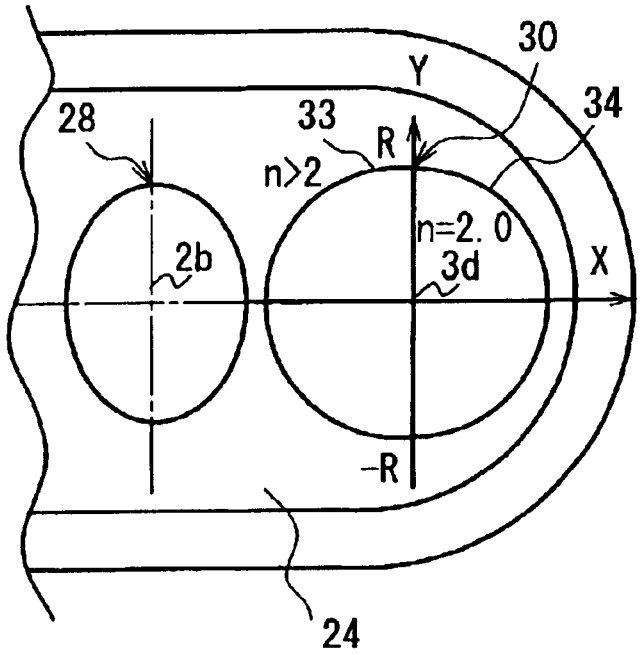
FIG. 3B is an enlarged view showing a part of the second flat plate electrode shown in FIG. 2B.
Figure 4A:
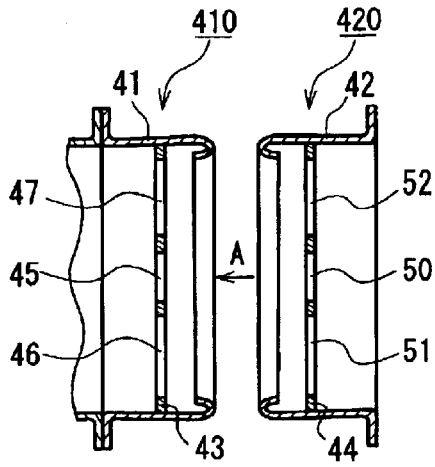
FIG. 4A PRIOR ART
FIG. 4A is a cross-sectional view of the G3 electrode and G4 electrode in the conventional inline electron gun.
Figure 4B:
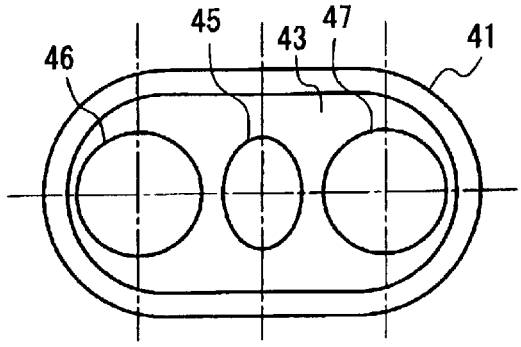
FIG. 4B PRIOR ART
FIG. 4B is a front view of the G3 electrode from the arrow A of FIG. 4A.
Figure 4C:
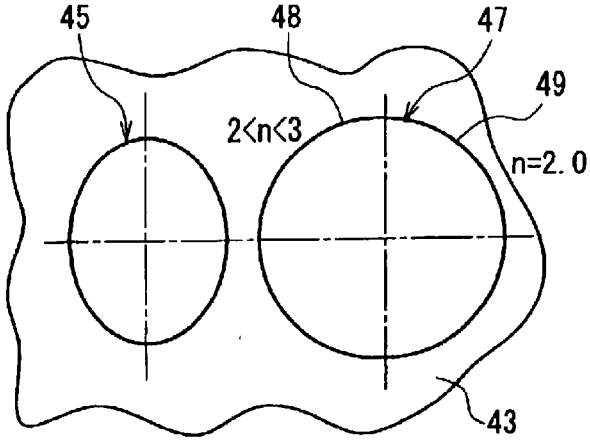
FIG. 4C PRIOR ART
FIG. 4C is an enlarged view of a part of the flat plate electrode illustrated in FIG. 4B.

The following describes the higher-order curves forming the opening geometry of the outer passage holes 26, 27, 29 and 30, with reference to FIG. 3. FIG. 3A is an enlarged view showing a part of the first flat plate electrode shown in FIG. 2A, and FIG. 3B is an enlarged view showing a part of the second flat plate electrode shown in FIG. 2B.

As shown in FIG. 3A, the higher-order curves forming the opening geometry of the outer passage hole 26 provided in the first flat plate electrode 23 include: a higher-order curve (inner curve) 31 located at the side of the central passage hole 25 with respect to the outer center line 3*b*; and a higher-order curve (outer curve) 32 opposed the inner curve and located outside of the outer center line 3*b*. Similarly, as shown in FIG. 3B, the higher-order curves forming the opening geometry of the outer passage hole 30 provided in the second flat plate electrode 24 include an inner curve 33 and an outer curve 34. Assuming x and y coordinates as shown in FIGS. 3A and 3B, these higher-order curves are represented by the following [Formula 1]. In this formula, n denotes the degree, which has different values between the outer and inner curves, as described as to FIG. 2. R denotes a y coordinate where the outer curve and the inner curve cross each other.

$$X^n+Y^n=R^n \qquad \text{[Formula 1]}$$

As shown in FIGS. 3A and 3B, the degree n of the inner curve 31 in the first flat plate electrode 23 is different from the degree n of the inner curve 33 in the second flat plate electrode 24. Whereas, the degree n of the outer curve 32 in the first flat plate electrode 23 is the same as the degree n of the outer curve 34 in the second flat plate electrode 24, where both n is 2. In the example of FIG. 3A and FIG. 3B, the degree n of the inner curve 31 is set at less than 2 (n<2), and the degree n of the inner curve 33 is set at more than 2 (n>2).

In the following sections, a relationship between the static convergence property of the main electrostatic lens of the inline electron gun and the degree n of the curve forming the opening geometry of the passage hole will be described. The following Table 1 indicates the amount of change ΔSk in the pitch of the small apertures in the G1 electrode, which is required for obtaining a favorable static convergence property when the degree of each curve forming the opening geometry of the outer passage holes provided in the flat plate electrodes is decreased by 0.1 from 2.0. The amount of change ΔSk is calculated by the three-dimensional electric field orbital calculation method, where a positive value of ΔSk represents an increase in the aperture pitch of the G1 electrode and a negative value of ΔSk represents a decrease in the pitch. Note here that a curve forming the outer passage holes in the flat plate electrodes, whose degree remains as it is, has a degree of 2.0.

In Table 1, ns1 denotes a case where the degree of the inner curves of the outer passage holes in the first flat plate electrode forming the G3 electrode is decreased by 0.1 from 2.0 (n=1.9), ns2 denotes a case where the degree of the outer curves of the outer passage holes in the first flat plate electrode forming the G3 electrode is decreased by 0.1 from 2.0 (n=1.9), ms1 denotes a case where the degree of the inner curves of the outer passage holes in the second flat plate electrode forming the G4 electrode is decreased by 0.1 from 2.0 (n=1.9), and ms2 denotes a case where the degree of the outer curves of the outer passage holes in the second flat plate electrode forming the G4 electrode is decreased by 0.1 from 2.0 (n=1.9).

TABLE 1

| | ns1 | ns2 | ms1 | ms2 |
|---|---|---|---|---|
| ΔSk | 0.035 | −0.014 | −0.031 | 0.01 |

Next, consideration will be given to a case where the static convergence property deteriorates because both outer electron beams pass through the main electrostatic lens made up of the G3 electrode and the G4 electrode and then cross each other before reaching the screen (i.e., a case where the convergence property of the main electrostatic lens is strong). In this case, if a higher priority is given to a favorable static convergence property so that the electron beams cross one another on the screen, then the pitch of the small apertures in the G1 electrode has to be decreased.

As for such a case, from the results shown in Table 1, ΔSk can be increased by setting the degree n of the inner curves of the outer passage holes in the first flat plate electrode at less than 2.0, which corresponds to the case of ns1, or by setting the degree n of the outer curves of the outer passage holes in the first flat plate electrode at more than 2.0, which corresponds to an inversion of the case of ns2. Also, ΔSk can be increased by setting the degree n of the inner curves of the outer passage holes in the second flat plate electrode at more than 2.0, which corresponds to an inversion of the case of ms1, or by setting the degree n of the outer curves of the outer passage holes in the second flat plate electrode at less than 2.0, which corresponds to the case of ms2.

Therefore, the pitch of the small apertures in the G1 electrode can be increased so as to realize a favorable static convergence property by setting the degree of n in this manner. As a result, the deterioration of the static convergence property can be suppressed without changing the pitch.

In addition, when considering the fact that the inner curve of the outer passage hole has a greater influence on the sensitivity of the amount of change ΔSk, compared with the outer curve thereof, it is preferable that the outer curve of the outer passage hole is a circle in a like manner as in the conventional one (the degree n=2). In this case, it is preferable that the degree n of the inner curve of the outer passage hole is set at less than 2.0 in the first flat plate electrode and at more than 2.0 in the second flat plate electrode.

Next, consideration will be given to a case where the static convergence property deteriorates because both outer electron beams pass through the main electrostatic lens and then do not cross each other before reaching the screen (i.e., a case where the convergence property of the main electrostatic lens is weak). In this case, if a higher priority is given to a favorable static convergence property so that the electron beams cross one another on the screen, then the pitch of the small apertures in the G1 electrode has to be increased.

As for such a case, from the results shown in Table 1, ΔSk can be decreased by setting the degree n of the inner curves of the outer passage holes in the first flat plate electrode at more than 2.0, which corresponds to an inversion the case of ns1, or by setting the degree n of the outer curves of the outer passage holes in the first flat plate electrode at less than 2.0, which corresponds to the case of ns2. Also, ΔSk can be decreased by setting the degree n of the inner curves of the outer passage holes in the second flat plate electrode at less than 2.0, which corresponds to the case of ms1, or by setting the degree n of the outer curves of the outer passage holes in the second flat plate electrode at more than 2.0, which corresponds to an inversion of the case of ms2.

Therefore, the pitch of the small apertures in the G1 electrode can be reduced so as to realize a favorable static convergence property by setting the degree of n in this manner. As a result, the deterioration of the static convergence property can be suppressed without changing the pitch. Furthermore, a change in the opening geometry of the passage holes in the flat plate electrodes can be made smaller compared with the conventional case, and the pitch of the passage holes in the flat plate electrodes does not need to be changed.

In addition, when considering the fact that the inner curve of the outer passage hole has a greater influence on the sensitivity of the amount of change ΔSk, compared with the outer curve thereof, it is preferable that the outer curve of the outer passage hole is a circle in a like manner as in the conventional one (the degree n=2). In this case, it is preferable that the degree n of the inner curve of the outer passage hole is set at more than 2.0 in the first flat plate electrode and at less than 2.0 in the second flat plate electrode.

However, as disclosed in the JP4 (1992)-133247 A, the spot shape can be approximately a circle when the degree of n of the outer or the inner curves of the outer passage holes is within a range of 2.05 to 2.25. Therefore, it can be said that the degree n of the inner or the outer curves of the outer passage holes is set preferably in a range of 1.7 to 2.3, inclusive. In this case, the distortion of the spot shape can be suppressed and a favorable static convergence property can be obtained.

As stated above, according to the inline electron gun of the present invention, the deterioration of the static convergence property can be suppressed without changing the pitch of the small apertures in the G1 electrode. Therefore, the manufacturing cost for an assembly jig of the electron gun can be reduced, for example, that might be generated with a change in the size of the cathode ray tube. In addition, in the inline electron gun according to the present invention, when the degree of the outer curves of the outer passage holes is set at the same value for the first flat plate electrode and the second flat plate electrode, and the degree of the inner curves is set at different values for the first flat plate electrode and the second flat plate electrode, then the manufacturing cost for an assembly jig of the electron gun can be reduced further.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An inline electron gun that emits three electron beams aligned along a horizontal direction, comprising a cylindrical low potential side electrode provided with a first flat plate electrode; and a cylindrical high potential side electrode provided with a second flat plate electrode, where the low potential side electrode and the high potential side electrode are arranged in the stated order along a direction in which the electron beams are headed so as to make up a main electrostatic lens, wherein each of the first flat plate electrode and the second flat plate electrode has a central passage hole for letting a central electron beam of the three electron beams pass therethrough and two outer passage holes for letting each of the other two outer electron beams pass therethrough, each of opening geometries of the two outer passage holes in the first flat plate electrode and each of opening geometries of the two outer passage holes in the second flat plate electrode are configured with a higher-order curve, each of the opening geometries of the two outer passage holes in at least one of the first flat plate electrode and the second flat plate electrode is formed by combining two higher-order curves having different degrees with a boundary on a center line of the outer passage hole along a vertical direction, and an opening geometry of one outer passage hole and an opening geometry of the other outer passage hole provided in a same flat plate electrode are symmetric with respect to a center line of a central passage hole provided in the same flat plate electrode along the vertical direction, and in a higher-order curve forming the opening geometries of the outer passage holes provided in the first flat plate electrode, at least one of (a) inner portions of the higher-order curve located at the side of the central passage hole with respect to the center lines of the respective outer passage holes along the vertical direction and (b) outer portions of the higher-order curve located outside have a different degree from a degree of corresponding portions of a higher-order curve forming the opening geometries of the outer passage holes provided in the second flat plate electrode.

2. The inline electron gun according to claim 1, wherein a degree of the inner portions of the higher-order curve of the outer passage holes provided in the first flat plate electrode is different from a degree of the inner portions of the higher-order curve of the outer passage holes provided in the second flat plate electrode.

3. The inline electron gun according to claim 2, wherein a degree of the outer portions of the higher-order curve of the outer passage holes provided in the first flat plate electrode is the same as a degree of the outer portions of the higher-order curve of the outer passage holes provided in the second flat plate electrode, and the degree is 2.

4. A color cathode ray tube comprising the inline electron gun according to claim 1.

5. A color cathode ray tube comprising the inline electron gun according to claim 2.

6. A color cathode ray tube comprising the inline electron gun according to claim 3.

* * * * *